US005611376A

United States Patent [19]

Chuang

[11] Patent Number: 5,611,376

[45] Date of Patent: Mar. 18, 1997

[54] VACUUM CONTAINER

[76] Inventor: Shiao-Cheng Chuang, No. 143, Chung Yi Rd., Tao Yuan, Taiwan

[21] Appl. No.: 442,093

[22] Filed: May 16, 1995

[51] Int. Cl.[6] ..... B65B 51/16

[52] U.S. Cl. ..... 141/65; 141/98; 220/231; 215/229; 215/311; 417/553

[58] Field of Search ..... 141/65, 98, 27; 220/212, 212.5, 231; 215/228, 311; 417/553

[56] References Cited

U.S. PATENT DOCUMENTS

| | | | |
|---|---|---|---|
| 4,989,745 | 2/1991 | Schneider | 141/65 |
| 5,390,809 | 2/1995 | Lin | 141/65 |
| 5,405,038 | 4/1995 | Chuang | 141/65 |
| 5,449,079 | 9/1995 | Yang | 215/228 |
| 5,469,979 | 11/1995 | Chiou | 141/65 |

FOREIGN PATENT DOCUMENTS

| | | | |
|---|---|---|---|
| 308083 | 6/1955 | Switzerland | 417/553 |

*Primary Examiner*—Henry J. Recla
*Assistant Examiner*—Steven O. Douglas
*Attorney, Agent, or Firm*—Bacon & Thomas

[57] ABSTRACT

A vacuum container including a container body, a cover covered on the container body, the cover having a top recess with air vents and a side opening, a switch mounted in the top recess and controlled by hand to close/open the air vents on the top recess for letting outside air flow into the container body, and an extraction pump mounted in the side opening on the container cover and reciprocated to draw air out of the container body.

3 Claims, 5 Drawing Sheets

VACUUM CONTAINER

BACKGROUND OF THE INVENTION

The present invention relates to containers, and relates more particularly to a vacuum container which has an extraction pump for drawing air out of the container to form a vacuum inside the container, and a switch controlled to open an exhaust port for letting outside air flow into the container to expel the vacuum for permitting the container cover to be opened.

When a container is maintained in a vacuum condition, things can be kept intact inside the container for a long period of time. When to draw air out of a container in order to produce a vacuum in it, a separate extraction pump or like means must be used.

SUMMARY OF THE INVENTION

The present invention has been accomplished to provide a vacuum container which is equipped with an extraction pump for drawing air out of the container for forming a vacuum in the container. The extraction pump is mounted in a side opening on the container cover, therefore the installation of the extraction pump does not increase the storage space of the container.

DETAILED DESCRIPTION OF THE PREFERRED EMBODIMENT

Figure 1:
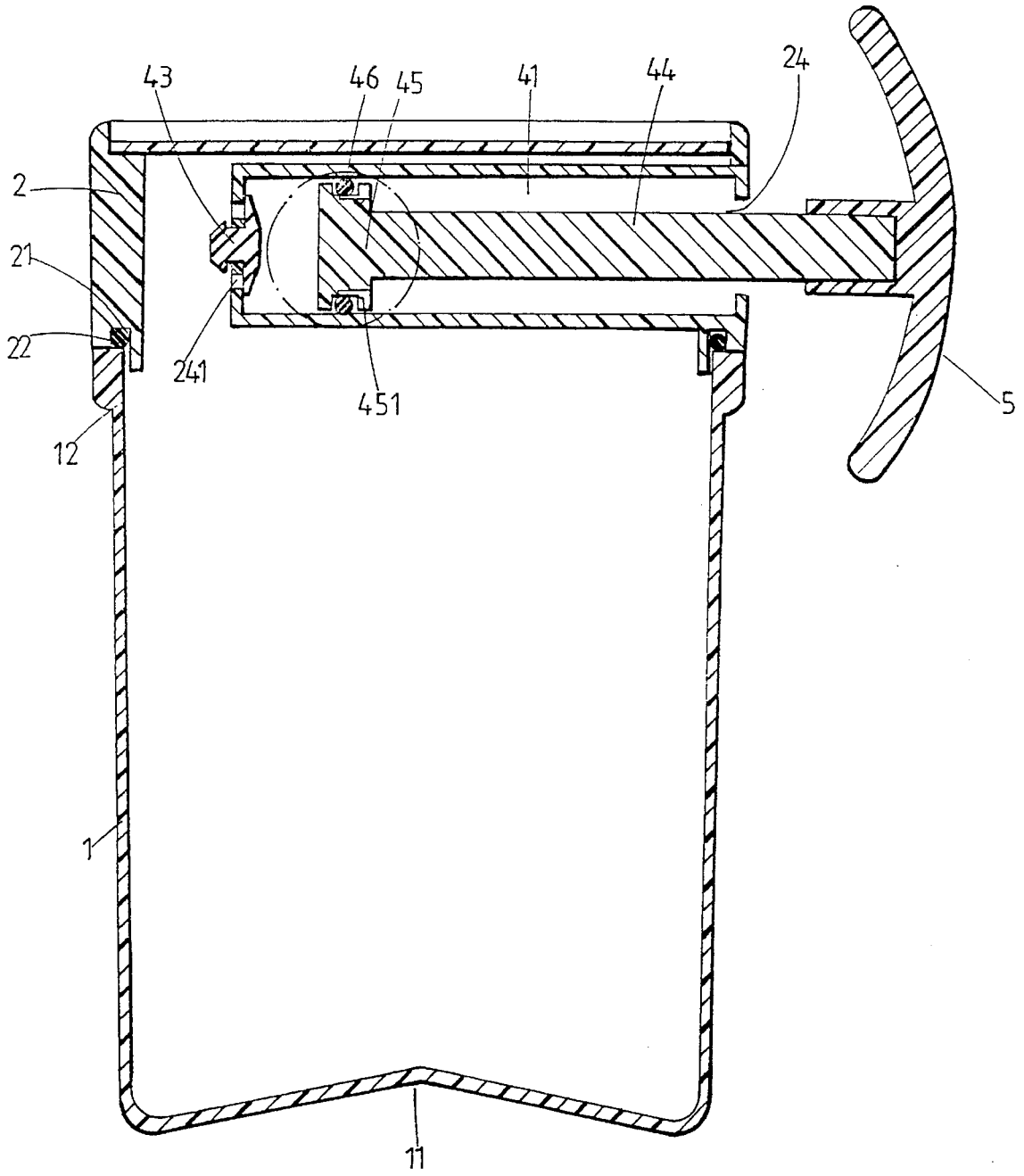
FIG. 1 is a side view in section of a vacuum container according to the present invention.
Figure 2:
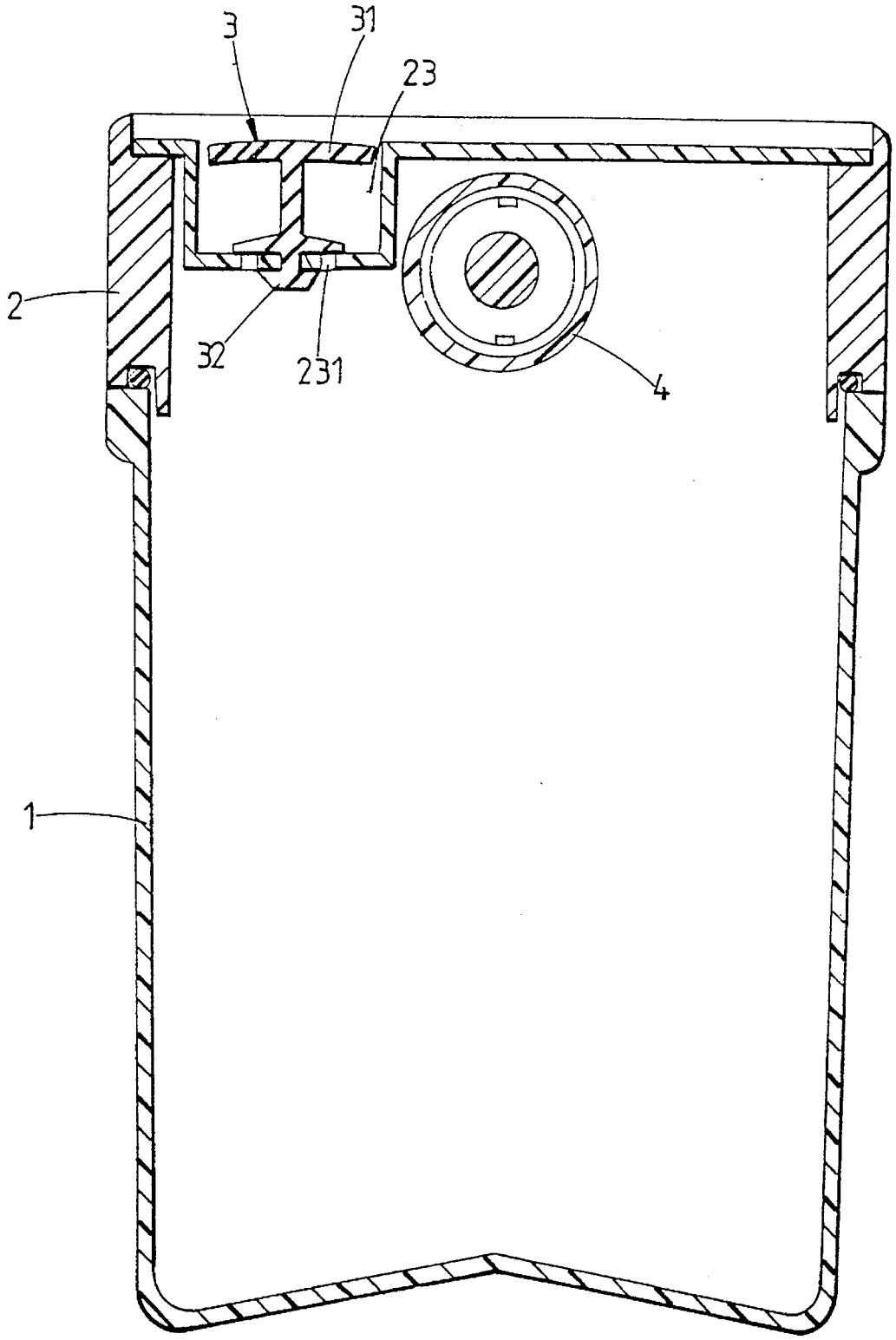
FIG. 2 is another sectional view of the vacuum container shown in FIG. 1, showing the position of the switch in the top recess on the container cover.

Referring to FIGS. 1 and 2, the present invention is comprised of a container body 1, a container cover 2, a switch 3, and an extraction pump 4.

The container body 1 has a close bottom side 11 smoothly curved inwards, a top flange 12 around the top open side thereof. The container cover 2 comprises an bottom groove 21 mounted with a rubber ring 22 for engagement with the top flange 12 of the container body 1 to seal the gap between the container body 1 and the container cover 2, a top recess 23 near the border, and a plurality of air vents 231 through the top recess 23. The switch 3 is a substantially T-shaped button mounted in the top recess 23, comprising a press portion 31 at the top for pressing by a finger, a flap valve 32 at the bottom controlled by the press portion 31 to close/open the air vents 231. The container cover 2 further comprises a side opening 24 adjacent to the top recess 23 for mounting the extraction pump 4. The extraction pump 4 comprises a cylinder 41, a piston rod 44 reciprocated in the cylinder 41, a piston 45 with axial grooves 451 at the inner end of the piston rod 44, a handle 5 at the outer end of the piston rod 44, a rubber ring 46 mounted around the grooves 451, a plurality of air vents 241 communicated between the inside space of the cylinder 41 and the inside space of the container body 1, and a flap valve 43 controlled to close/open the air vents 241.

Figure 3:
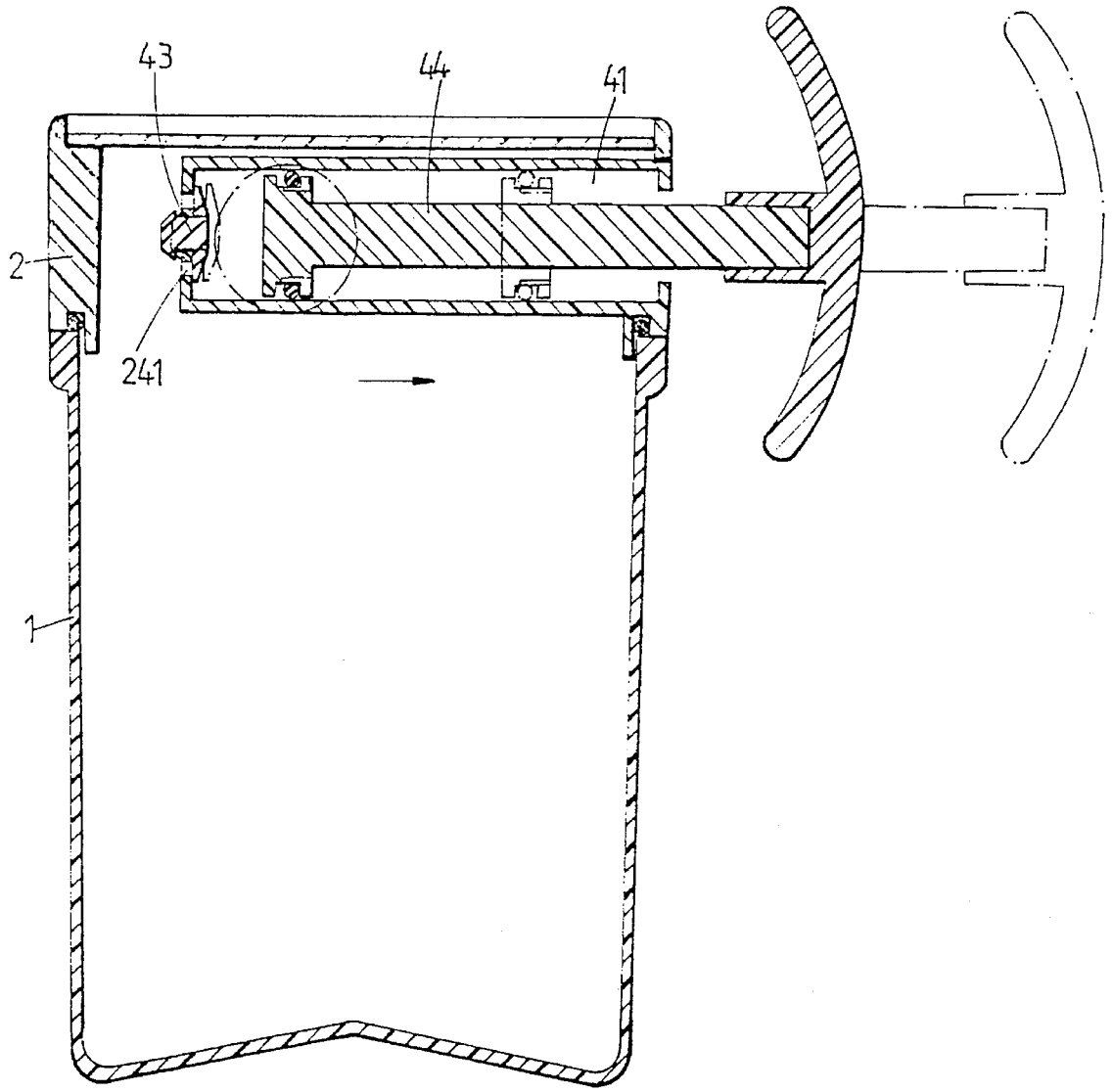
FIG. 3 is similar to FIG. 1 but showing the extraction pump reciprocated.
Figure 4:
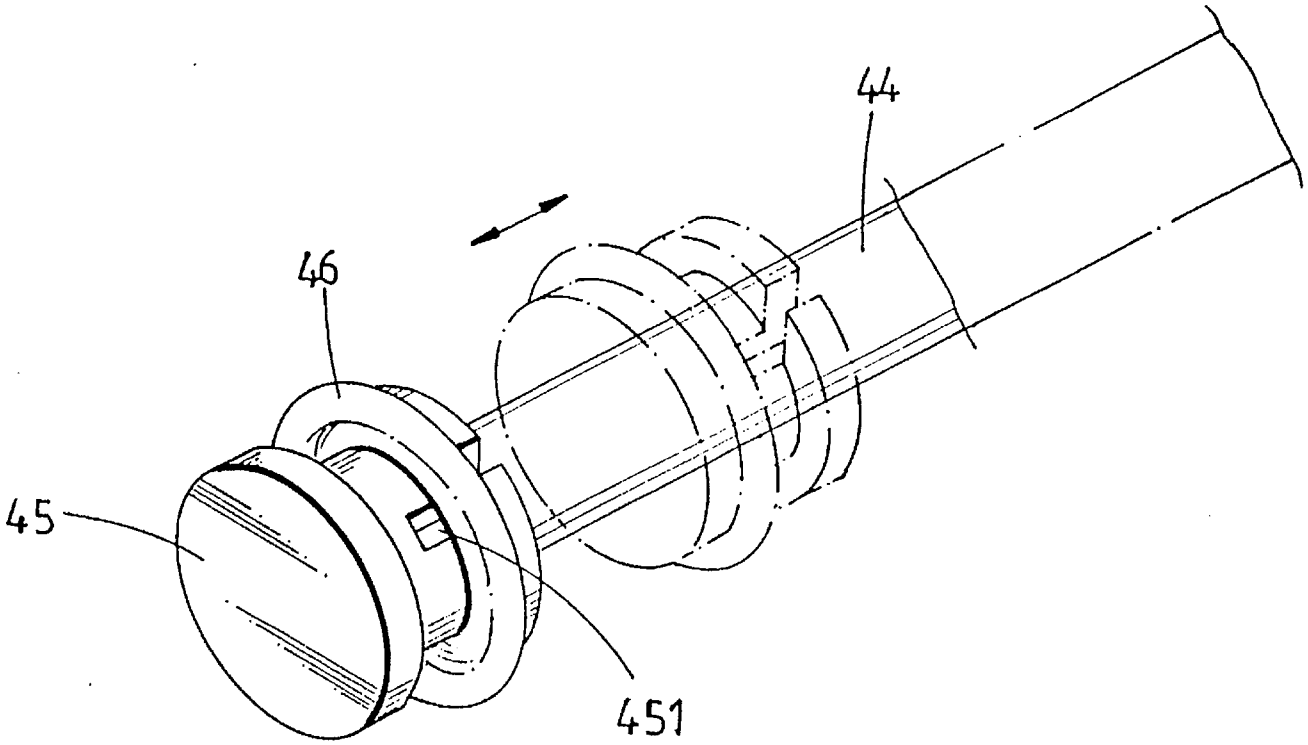
FIG. 4 is an enlarged view of the piston rod and the piston according to the present invention.

Referring to FIGS. 3 and 4, when the piston 45 is moved outwards by the handle 5 through the piston rod 44, the flap valve 43 is opened to let air be drawn out of the container body 1 through the air vents 241 into the cylinder 41; when the piston 45 is moved inwards the flap valve 43 is forced to close the air vents 241, causing air inside the cylinder 41 to be forced out of the cylinder 41 and the container cover 2 through the axial grooves 451 and the side opening 24.

Figure 5:
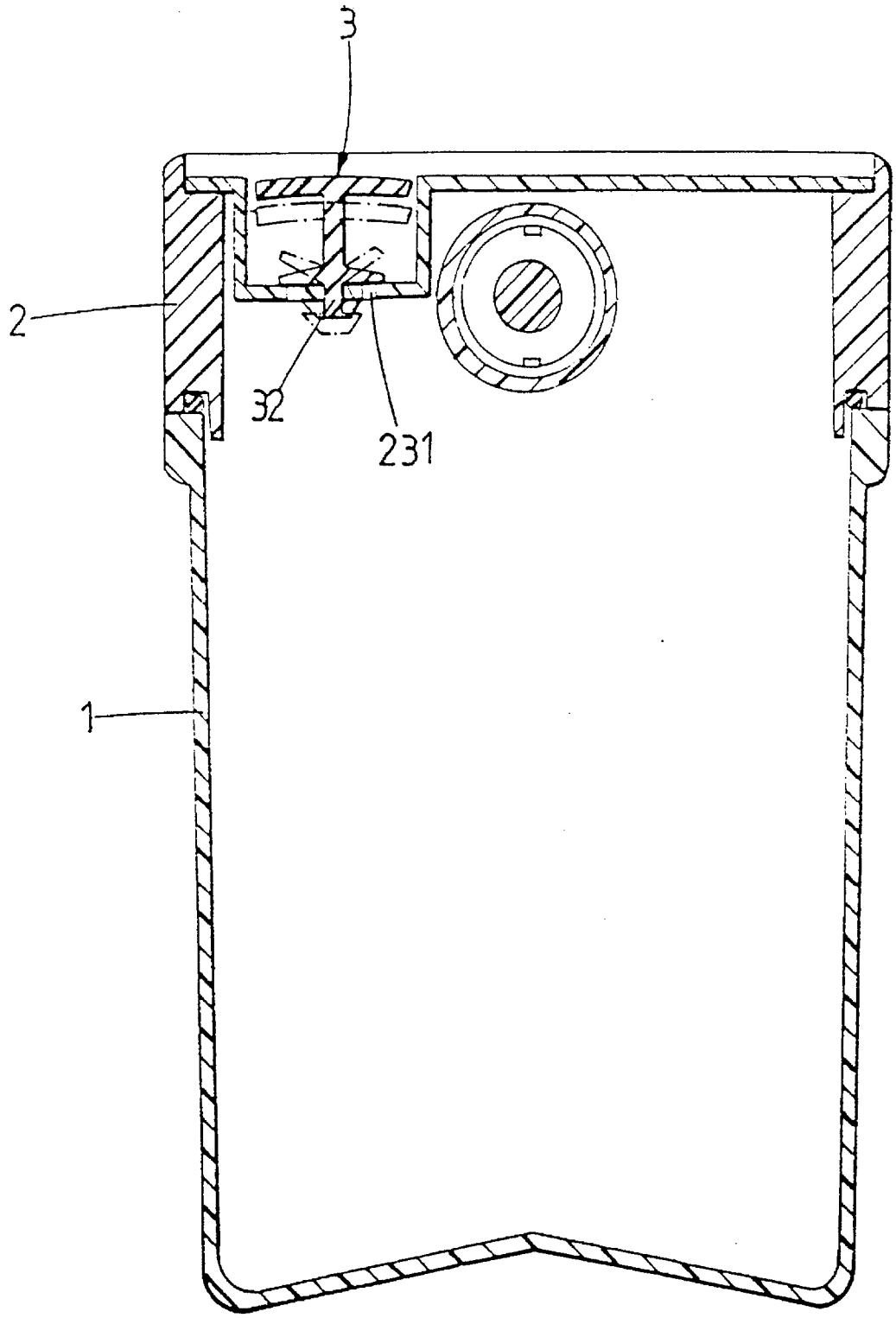
FIG. 5 is similar to FIG. 2 but showing the switch depressed and the flap valve opened.

Referring to FIG. 5, when the switch 3 is depressed, the flap valve 32 is opened to let outside air flow through the air vents 231 into the container body 1, and therefore the container cover 2 can be opened from the container body 1.

It is to be understood that the drawings are designed for purposes of illustration only, and are not intended as a definition of the limits and scope of the invention disclosed.

I claim:

1. A vacuum container comprising:

a) a housing including a dosed bottom side and an upwardly extending annular wall terminating in a flange defining a top opening;

b) a cover including a top wall and a downwardly extending annular side wall terminating in a bottom edge provided with an annular groove, a sealing ring disposed within the annular groove, the cover being engageable on the housing to dispose the sealing ring in sealing engagement with the flange of the housing and define an enclosed spaced therebetween;

c) a recess formed in the top wall of the cover adjacent the side wall, the recess including a bottom wall provided with a vent means formed therein and a valve means disposed within the recess for opening and closing the vent means; and d) an opening formed in the side wall of the cover, and an elongate pump means extending inwardly of the opening and disposed within the enclosed space for drawing air from the enclosed space.

2. The vacuum container of claim 1 wherein the valve means includes a T-shaped button.

3. The vacuum container of claim 1 wherein the pump means includes a cylinder, having an internal end disposed within the enclosed space, a piston rod including a first end and a second end, the first end of the piston rod being disposed within the cylinder, a piston mounted to the first end of the piston rod, the piston including a plurality of axial exhaust grooves around a periphery thereof, a handle mounted on the second end of the piston rod and disposed externally of the cover opening, a rubber ring mounted around the piston, a plurality of air vents formed in the internal end of the cylinder to provide communication between the enclosed space and the interior of the cylinder, and valve means for opening and closing the air vents during reciprocation of the piston rod.

* * * * *